United States Patent [19]

Richan

[11] 4,071,143

[45] Jan. 31, 1978

[54] ORE SEPARATING METHOD AND APPARATUS

[76] Inventor: Max R. Richan, 545 N. 3rd East, Brigham City, Utah 84302

[21] Appl. No.: 746,955

[22] Filed: Dec. 2, 1976

[51] Int. Cl.[2] ..... B03B 5/74

[52] U.S. Cl. ..... 209/444; 209/506; 239/222.11

[58] Field of Search ..... 209/435, 444, 438, 445, 209/453, 459, 471, 477, 479, 483, 506, 507, 485, 148, 150; 239/223, 222, 11, 681, 687; 34/59; 222/410; 159/4 S; 198/642

[56] References Cited

U.S. PATENT DOCUMENTS

| | | | |
|---|---|---|---|
| 289,261 | 11/1883 | Hershey | 209/479 |
| 774,048 | 11/1904 | Denison | 209/444 |
| 1,306,270 | 6/1919 | Miller | 209/444 |
| 3,802,916 | 4/1974 | Jackson | 134/10 |

*Primary Examiner*—Frank W. Lutter
*Assistant Examiner*—Ralph J. Hill
*Attorney, Agent, or Firm*—Robert A. Bingham

[57] ABSTRACT

The invention relates to a method and apparatus for separating ore. The apparatus includes a rotatable conical cap having a rounded top, inwardly curving sides and a riffle extending vertically from the circumference of the base. An ore-water slurry is allowed to flow down the sides of the rotationally agitating cap and into the riffle, which retains the heavy metals but allows the tailings to be carried over the riffle. The inward curvature of the sides cause centrifugal separation of the metals from the tailings in the slurry stream.

25 Claims, 5 Drawing Figures

ORE SEPARATING METHOD AND APPARATUS

The invention relates to ore separation or concentration for the purpose of recovering heavy metals. More particularly, the invention relates to a method and apparatus for gravitationally separating precious metals from an ore-water slurry through use of a separation surface comprising a rotatable conical member with a circumferential riffle. The invention is particularly useful for mining gold.

BACKGROUND OF THE INVENTION

Ore separating devices are well known in the art. Perhaps the most common is the pan or batea (a pan with radial corrugations). Its use and operation is well-known.

The cradle or rocker was an improvement over the pan. An ore-water slurry was dropped onto an apron which distributed the slurry across the riffles, which were pieces of wood or iron perpendicular to the bottom and sides of the cradle. The apparatus was continuously rocked, and as the material moved through the rocker, the gold or heavy metals were caught by the riffles. When enough gold was accumulated, the riffles were cleaned. The riffle is also widely used in sluice boxes and corduroy tables. The name is commonly applied to any strip, bar, or groove placed at right angles to the flowing stream to provide a protective spot where gold can settle. A sluice box is an inclined wooden trough, through which an ore-water slurry stream passes. The gold sinks to the bottom and lodges behind crossbars or riffles in the trough bottom. The corduroy table consists of wide sloping plates with shallow sides which hold a coarse corduroy cloth. Periodically, the corduroy is removed and washed by hand in boxes partly filled with water to recover the gold-rich concentrates. With any of the foregoing apparatuses, additional separation of the retained concentrates, such as by panning, is normally required.

With the exception of panning, which is a slow process, the foregoing apparatuses have recovery efficiencies of only about 60%. The present invention, which also employs riffle separation, produces gold recoveries of 90 to 100% after panning of recovered concentrates.

Separating machines of varying sophistication employing conically-shaped separation surfaces have also been suggested. See U.S. Pat. Nos. 228,125, 382,833, 654,662, 774,048, 1,306,270 and 3,802,916. The present invention employs a conically-shaped separation surface; however, the separation surface and other parts of the apparatus are uniquely configured to maximize recovery and ease of operation.

SUMMARY OF THE INVENTION

The apparatus of the present invention comprises an upright, rotatable conical cap having a truncated, rounded top, sides, a base, and a riffle extending vertically from the circumferance of the base. The sides of the cap curve inwardly between the top and the base of the cap. Also included are a means for rotationally agitating the cap and a means for evenly introducing a uniform slurry ore to the rounded top of the cap at a low velocity. In operation, the slurry gravitationally and evenly flows down the sides of the agitating cap and changes flow direction with the inward curviture of the side, whereby such change in direction centrifugally separates the heavier precious metals in the slurry from the lighter ore tailings with the result that the heavier metals are captured by the riffle and the lighter tailings are carried over the riffle and away.

The present invention also relates to the above-described conical cap for separating ore.

The present invention also relates to a method of separating ore comprising continuously introducing at a low velocity a slurry of ore to a truncated, rounded top of an upright, rotatable conical cap, the top having an effective diameter of about 2 inches or greater; continuously rotationally agitating the cap; allowing the slurry to flow evenly and circumferentially down the sides toward the base of the cap at an angle of from about 30° to about 45° from the axis of the cap for a distance of at least about 3.5 inches; then gradually changing the direction of the flow of the slurry along about a 2 inch arc formed by the sides of the cap, the directional change being from about 10° per inch to about 15° per inch in order to separate centrifugally heavy metals in the ore from the lighter, remaining tailings; and then directing the flow into a circumferential riffle, the top of which is at a level which approximately bisects the 2 inch arc. By this method, the heavy metals in the ore are retained by the riffle and the lighter ore tailings are carried over the riffle and away.

The present invention effects metal recoveries of the order of 90–100%.

DETAILED DESCRIPTION OF THE INVENTION

Figure 1:
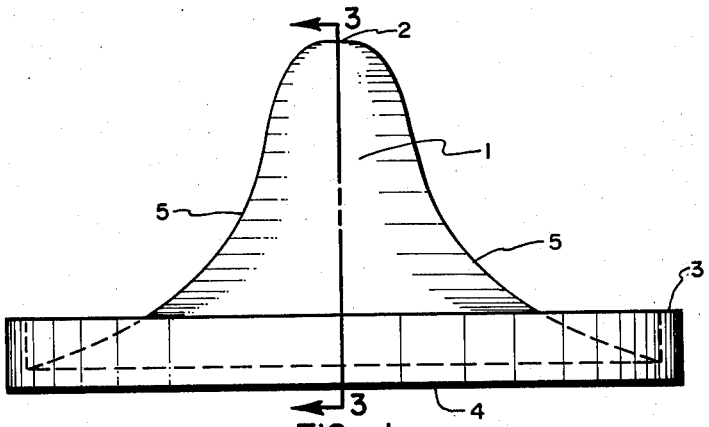
FIG. 1 is a side view of the cap of the present invention.

As shown in FIG. 1, the cap 1, which is rotatable, has a truncated rounded top 2, sides 5, which curve inwardly between the top 2 and the base 4, and a riffle 3 which extends vertically from the circumference of the base 4.

Figure 3:
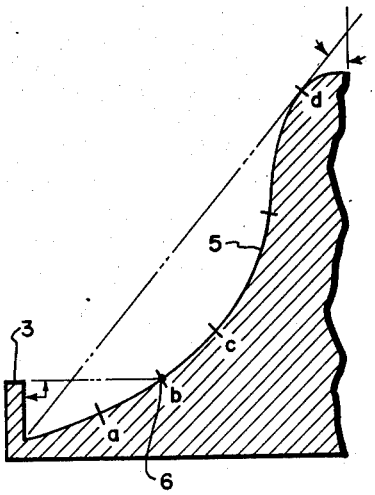
FIG. 3 is an expanded sectional view taken along line 3—3 of FIG. 1.

In FIG. 3, a vertical reference point 6 is located by the perpendicular from the top of riffle 3 as shown. Arc ab extends below reference point 6 and arc bc extends above it about the same distance. Arc cd extends from the top of the cap to the beginning of arc ac.

In operation, cap 1 of FIG. 1 is rotationally agitated by a conventional power source and linkage (not shown). The agitation frequency is between about 100 to about 150 cycles per minute. The degree of agitation is sufficient to produce a displacement of a point on the riffle 3 of about 1 inch to about 1.5 inches each half cycle.

A uniform slurry mixture of ore and water is evenly introduced to the rounded top 2 of the cap 1 at a low velocity (slurry introduction means not shown). The slurry velocity is kept as low as possible in order to minimize splashing as the slurry impacts with top 2. The slurry then gravitationally and circumferentially flows down the sides 5 of cap 1. The direction of flow of the slurry gradually changes with the inward curvature of the sides 5 between the top 2 and the base 4 of the cap.

The directional change imparts a centrifugal force to the slurry, thereby causing the heavier precious metal particles to penetrate to the bottom of the slurry stream. The slurry stream then impacts with riffle 3 or with the reservoir of slurry which, during steady state operation, accumulates behind riffle 3 to the level of the riffle. The heavier metals are captured by the riffle and the lighter ore tailings are carried over the riffle and away with the water. The rotational agitation of cap 1 prevents channeling of the slurry through deposited ore, aids the settling of the heavy metals and helps maintain the lighter ore tailings in suspension in the accumulated reservoir behind riffle 3 so that they can be continually carried over the riffle during steady state operation. In this fashion, concentration or separation of the heavy metals in the ore is accomplished. A continuous operation will result in a gradual accumulation of heavy metals behind the riffle. Periodically, the riffle can be cleaned of concentrate.

Figure 2:
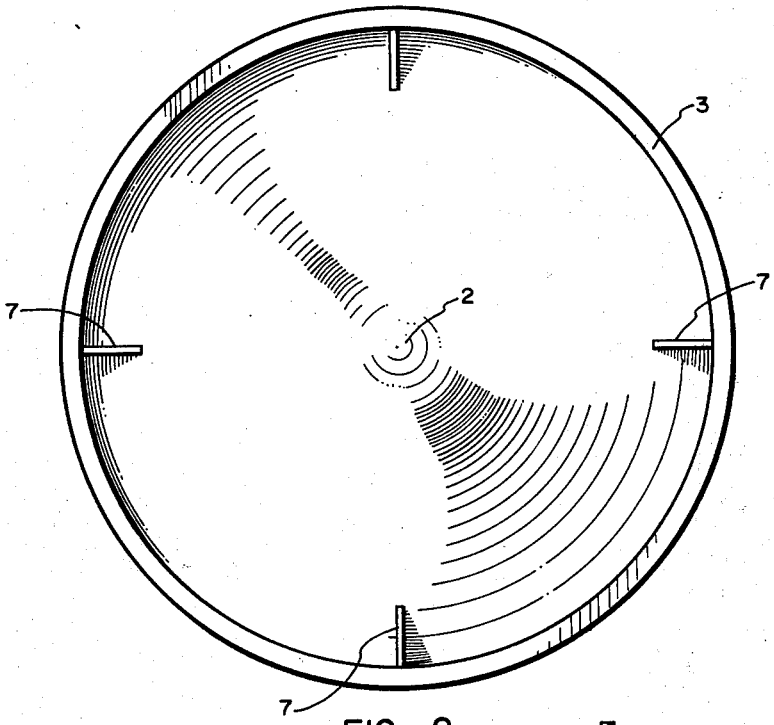
FIG. 2 is a top view of a cap.
Figure 4:
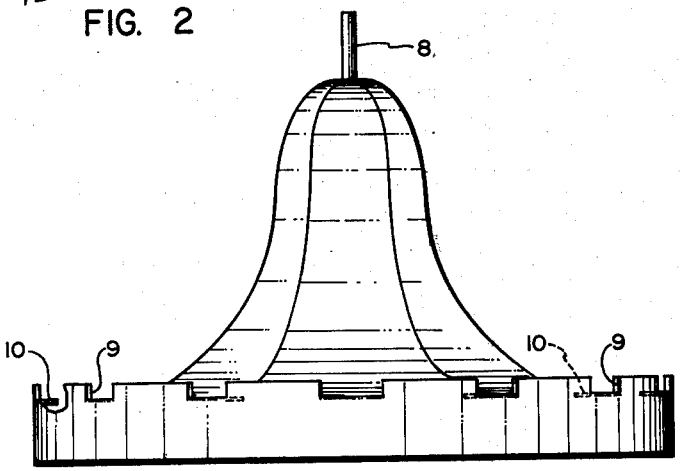
FIG. 4 is a side view of a preferred form of a cap.

Preferably, the diameter of the base of the cap is from about 10 inches to about 24 inches and the rounded top has an effective diameter of about 2 inches. The top is rounded in order to provide an even, circumferential distribution of the slurry down the sides of the cap and to minimize splashing. Other preferred embodiments are as follows:

a. The curve cd is at least 4.5 inches. Partial gravitational separation of the ore occurs during the flow of slurry over this portion and this minimum distance has been found to be particularly effective.

b. The arcs ab and bc extend about 1 inch below and above, respectively, the reference point 6, and the subtended angle of the arc ac is from about 20° to about 30°. Thus arc ac is about 2 inches and has a curvature of about 10° per inch to about 15° per inch. It has been found that an arc of this length, position and curvature is particularly advantageous for centrifugally effecting separation of the heavy metals in the ore. Arc ab extends below the level of the reservoir slurry, which accumulates behind the riffle to the level of reference point 7. As the slurry stream impacts with the reservoir, the heavy metals tend to penetrate to the bottom of the reservoir and the lighter ore tailings tend to skim or spread out over the surface of the reservoir. The curvature of arc *ab* insures that separation will continue below the reservoir level, at least as long as the slurry stream continues its flow, and that the overall directional flow change continues to be gradual so that smooth separation is not disrupted.

c. FIG. 4 shows a preferred cap. A cylindrical extension 8 from the top of the cap further minimizes splashing of the slurry when the slurry is introduced first to extension 8, which then guides the slurry evenly to the top of the cap. The riffle contains notches 9 spaced circumferentially around the riffle at preferably about 3 inches intervals between adjacent notch sides. The notches are preferably about 1 inch wide and about 0.5 inches deep. Tangs 10 extend inwardly from the notches as shown. Generally, the notch is formed by bending the tang inward. The tang is correspondingly about 1 inch by about 0.5 inches. It has been found that this notched riffle enhances metals recovery and cap operation. When the riffle configuration of FIG. 4 is not used, it is preferred to use baffles 7, shown in FIG. 2, in order to maintain an even dispersion of slurry behind the riffle and to enhance recovery. The baffles may be spaced as desired, but should be located at least every 90°. The baffles need not be as high as the riffles.

d. Although not necessarily preferred, FIG. 4 shows a pyramidal cap. The sides of the conically shaped cap may by pyramidal, with various numbers of sides, rather than rounded as in FIG. 1.

e. The slurry is preferably composed of from about 50 to about 70% water with the balance being ore of particle size of about 0.5 inches or smaller.

f. The sides of the cap preferably extend downward from the top at an angle of about 30° to about 45° from the axis of the cap, as shown in FIG. 3.

The material used for the sides of the cap is not critical. Fabric, wood, metal, plastic, etc., can be used. If fabric is used, then a shaft is placed through the base to the top of the cap for support. A ring at the top is also used to provide for a rigid, rounded top.

The composition of the ore is not critical and both gravel and clay-based ores and composites can be treated by the present invention.

Figure 5:
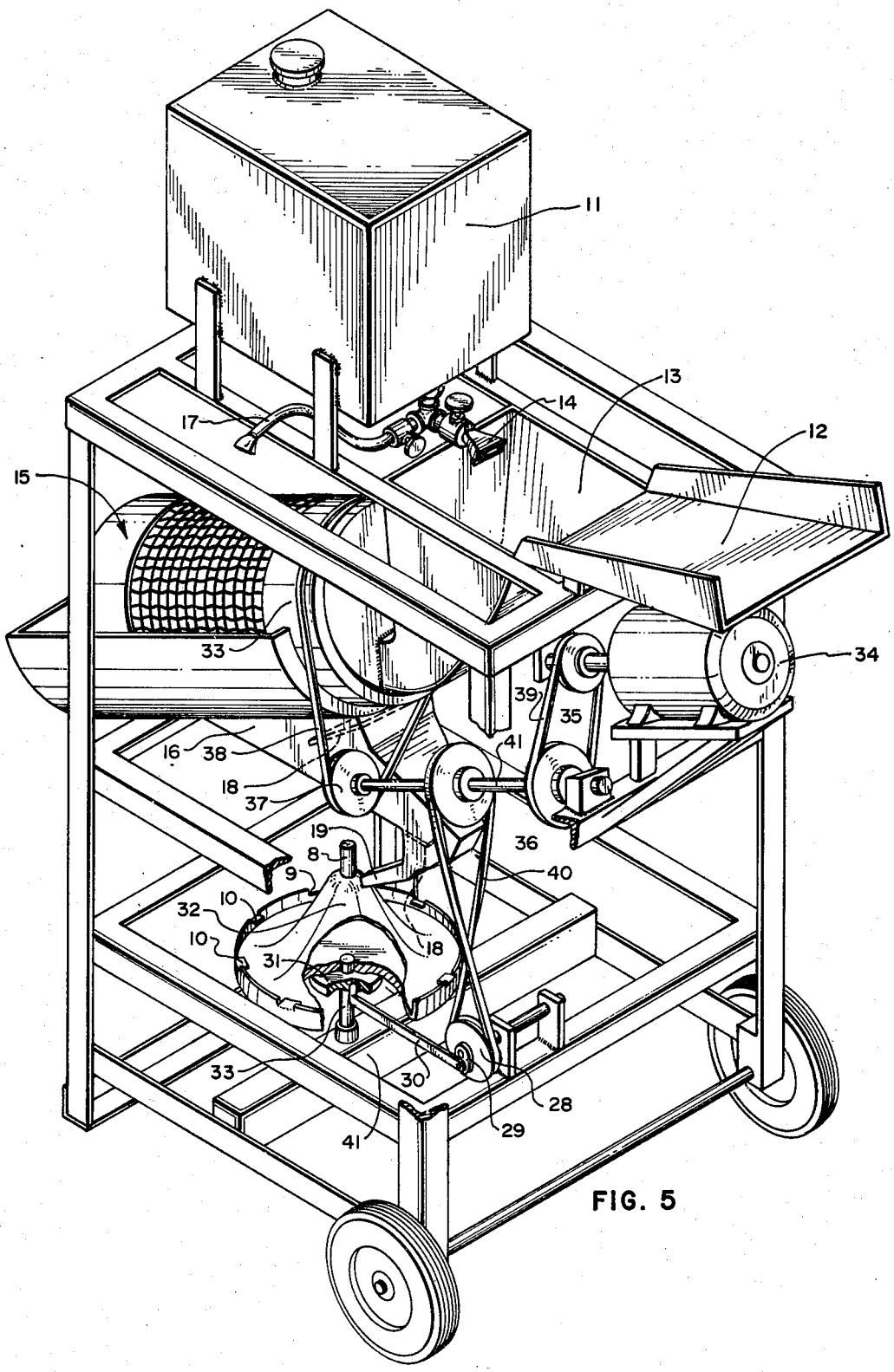
FIG. 5 is a partially schematic illustration of an embodiment of the apparatus and system utilized in separating ore in accordance with the method of the present invention.

FIG. 5 shows a complete apparatus for separating ores in accordance with the invention. A water tank 11 supplies water to the ore which enters hopper 13 from chute 12. The water enters hopper 13 through line 14 and initially mixes with the ore. The ore-water mixture gravitationally flows into a rotating tumbler 15, which has seives, as shown, of desired size, preferably about 0.5 inches or less. Water line 17 sprays water into the tumbler 15 to prevent the mixture from climbing the walls of the tumbler. The resulting slurry, properly sized, flows from the tumbler into sluice 16, which preferably contains baffles 18 to change the direction of the slurry and thereby reduce its velocity before it is discharged from chute 19 to the top of rotationally agitating cap 32. The operation of cap 32 is as previously described.

The driving means and linkages for the dynamic operations of the apparatus is FIG. 5 can be selected from among many by those skilled in the art. The belt and pulley system shown runs off a single power source 34 or by hand, although separate power sources could be used. Pulley 28 is driven by the power source 34 through belts 39 and 40, which drive pulleys 35 and 36, which are rotatably mounted on shaft 41. Crank 29, connected to pulley 28, drives rod 30, rotatably connected to crank 29. The opposite end of Rod 30 is rotatably connected to plate 31 which in turn is connected to cap 32. Rod 30 rotationally agitates cap 32 which rotates on shaft 33 by means of a bushing (not shown) in plate 31. The shaft 33 is mounted in stand 41. Pulley 37 and belt 38 drive the tumbler 33.

An example of a preferred apparatus and method of the invention is as follows. The apparatus disclosed schematically in FIG. 5 was operated semi-continuously for several hours. A slurry composed of 60% water, a preferred amount, and 40% ore was mixed in the tumbler, which had a seive size of 7/16 inch. The ore was a sand, gravel, decayed granite and clay composite and had a gold concentration of 8–9 gms/yd$^3$. The dry weight of the ore was 1.5 tons/yd$^3$. The cap of FIG. 4 was 13 inches in diameter at its base and 6 inches high, had a 2 inch rounded top and a ¾ inch cylindrical extension from the top, was pyramidal with six sides, was composed of metal, and had sides which extended from the top at an angle of 40° from the axis of the cap, the inward curvature of the sides being as described previously. The riffle was 1 inch high and the notches were 0.5 inches deep and 1 inch wide and were spaced about 3 inches apart, end to end. The cap was agitated at 120 cpm. The ore was fed to the apparatus at a rate of about 0.5 tons/hr. at 20 minute intervals. At the end of each interval, the cap was washed with water until the level of the reservoir decreased to the level of the bottom of the notch. The remaining concentrate, approximately 3.5 ounces, was then panned for final separation. The 20 minute operating time was optional and did not necessitate cleaning of the riffle. The interval could have been up to about 3 hours. About 1500 pounds of ore were processed in this manner and about 4.5 gms of gold were recoverd for a recovery of 97%.

While the present invention has been described with reference to certain illustrative examples and preferred embodiments, various modifications are intended to be within the scope of the invention as set forth in the appended claims.

What is claimed is:

1. An ore-separating apparatus comprising:

a. an upright, rotatable conical cap having a truncated, rounded top, sides, a base, and a riffle extending vertically from the circumference of the base, the sides of the cap curving inwardly between the top and the base wherein the inwardly curving sides of the cap extend downward from the top at an angle of from about 30° to about 45° from the axis of the cap and form an arc having a subtended angle of from about 20° to about 30°;

b. a means for rotationally agitating the cap; and c. a means for evenly introducing a uniform slurry of ore to the rounded top of the cap at a low velocity;

so that the slurry gravitationally and evenly flows down the sides of the agitating cap and changes flow direction with the inward curvature of the sides, whereby such change in direction contrifugally separates heavier precious metals in the slurry from lighter ore tailings with the result that the heavier metals are captured by the riffle and the lighter tailings are carried over the riffle and away.

2. An apparatus according to claim 1 wherein the arc extends about 1 inch above and about 1 inch below a vertical reference point level with the top of the riffle, the distance between the top of the cap and the reference point being at least 4.5 inches.

3. An apparatus according to claim 1 wherein the agitating means is adapted to produce a rotational agitation of the cap of between about 100–150 cycles per minute and to produce a displacement of a point on the riffle of about 1 inch to about 1.5 inches each half cycle.

4. An apparatus according to claim 2 wherein the riffle is from about 0.5 inch to about 1.5 inches high.

5. An apparatus according to claim 2 wherein the base of the cap is from about 10 inches to about 24 inches in diameter.

6. An apparatus according to claim 2 wherein the riffle is notched at successive intervals with tangs extending inwardly toward the sides of the cap.

7. An apparatus according to claim 6 wherein the base of the cap is at least about 10 inches in diameter, the riffle is about 1 inch high, the notches are about 1 inch wide and 0.5 inch deep and are spaced circumferentially around the riffle about 3 inches apart, and correspondingly, the tangs are about 1 inch wide and extend inwardly about 0.5 inch.

8. An apparatus according to claim 2 wherein the rounded top of the cap has an effective diameter of about 2 inches and contains a cylindrical extension which is smaller in diameter than the top and which helps minimize splashing of the slurry.

9. An apparatus according to claim 2 wherein the cap is pyramidal.

10. An apparatus according to claim 1 wherein the agitating means is adapted to produce a rotational agitation of the cap of between about 100–150 cycles per minute and to produce a displacement of a point on the riffle of about 1 inch to about 1.5 inches each half cycle.

11. An apparatus according to claim 10 wherein the riffle is notched at successive intervals with tangs extending inwardly toward the sides of the cap, the base of the cap is at least about 10 inches in diameter, the riffle is about 1 inch high, the notches are about 1 inch wide and 0.5 inch deep and are spaced circumferentially around the riffle and about 3 inch apart, and correspondingly, the tangs are about 1 inch wide and extend inwardly about 0.5 inch.

12. An apparatus according to claim 11 wherein the rounded top of the cap has an effective diameter of about 2 inches and contains a cylindrical extension which is smaller in diameter than the top and which helps minimize splashing of slurry.

13. An upright, rotatable conical cap for separating ore comprising a truncated, rounded top, sides, a base, and a riffle extending vertically from the circumference of the base, the sides of the cap curving inwardly between the top and the base, wherein the inwardly curving sides extend downward from the top at an angle of from about 30° to about 45° from the axis of the cap and form an arc having a subtended angle of from about 20° to about 30°, the cap adapted to be rotationally agitated.

14. A cap according to claim 13 wherein the arc extends about 1 inch above and about 1 inch below a vertical reference point level with the top of the riffle, the distance between the top and the reference point being at least 4.5 inches.

15. A cap according to claim 14 wherein the riffle is from about 0.5 inch to about 1.5 inches high.

16. A cap according to claim 14 wherein the base is from about 10 inches to about 24 inches in diameter.

17. A cap according to claim 14 wherein the riffle is notched at successive intervals with tangs extending inwardly toward the sides of the cap.

18. A cap according to claim 17 wherein the base of the cap is at least about 10 inches in diameter, the riffle is about 1 high high, the notches are about 1 inch wide and 0.5 inch deep and are spaced circumferentially around the riffle and about 3 inches apart, and correspondingly, the tangs are about 1 inch wide and extend inwardly about 0.5inch.

19. A cap according to claim 14 wherein the rounded top of the cap has an effective diameter of about 2 inches and contains a cylindrical extension which is smaller in diameter than the top and which helps minimize splashing of the slurry.

20. A cap according to claim 14 wherein the cap is pyramidal.

21. A cap according to claim 13 wherein the riffle is notched at successive intervals with tangs extending inwardly toward the sides of the cap, the base of the cap is at least about 10 inches in diameter, the riffle is about 1 inch high, the notches are about 1 inch wide and 0.5 inch deep and are spaced circumferentially around the riffle and about 3 inches apart, and correspondingly, the tangs are about 1 inch wide and extend inwardly about 0.5inch.

22. A method for separating ore comprising:

a. continuously introducing at a low velocity a slurry of ore to a truncated, rounded to of an upright, rotatable conical cap, the top having an effective diameter of about 2 inches or greater;

b. continuously rotationally agitating the cap;

c. allowing the slurry to flow evenly and circumferentially down the sides toward the base of the cap at an angle of from about 30° to about 45° from the axis of the cap for a distance of at least about 3.5inches;

d. the gradually changing the direction of the flow of the slurry along about a 2 inches arc formed by the sides of the cap, the directional change being from about 10° per inch to about 15° per inch in order to separate centrifugally heavy metals in the ore from lighter, remaining tailings; and e. then directing the flow into a circumferential riffle, the top of which is at a level which approximately bisects the 2 inches arc;

whereby heavy metals in the ore are retained by the riffle and lighter ore tailings are carried over the riffle and away.

23. A method according to claim 22 whereby the slurry comprises from about 50 to about 70% water and the balance is ore of particle size about 0.5 inch or smaller.

24. A method according to claim 22 wherein the cap is rotationally agitated at from about 100 to about 150 cycles per minute and to the degree whereby a point on the riffle is displaced from about 1 inch to about 1.5 inches each half cycle.

25. A method according to claim 22 wherein the riffle is notched at successive intervals with tangs extending inwardly toward the sides of the cap, the base of the cap is at least about 10 inches in diameter, the riffle is about 1 inch high, the notches are about 1 inch wide and 0.5 inch deep and are spaced circumferentially around the riffle and about 3 inches apart, and correspondingly, the tangs are about 1 inch wide and extend inwardly about 0.5inch.

* * * * *